US008393813B2

(12) United States Patent
Yarlagadda

(10) Patent No.: US 8,393,813 B2
(45) Date of Patent: Mar. 12, 2013

(54) PERSONAL CARE PRODUCT DISPENSER SYSTEMS

(75) Inventor: Travis T. Yarlagadda, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 519 days.

(21) Appl. No.: 12/645,792

(22) Filed: Dec. 23, 2009

(65) Prior Publication Data

US 2011/0150555 A1 Jun. 23, 2011

(51) Int. Cl.

| | |
|---|---|
| ***A46B 11/08*** | (2006.01) |
| ***A45D 40/04*** | (2006.01) |
| ***A45D 40/06*** | (2006.01) |
| ***B43K 21/027*** | (2006.01) |
| ***B43K 21/22*** | (2006.01) |
| ***G01F 11/00*** | (2006.01) |

(52) U.S. Cl. ..... 401/52; 401/1; 401/49; 401/55; 401/68; 401/75; 401/92; 401/116; 222/333; 222/390

(58) Field of Classification Search ..... 401/1, 2, 401/52, 265; 222/333, 390
See application file for complete search history.

(56) References Cited

U.S. PATENT DOCUMENTS

| | | | | |
|---|---|---|---|---|
| 3,704,864 | A * | 12/1972 | Lee | 366/205 |
| 4,258,866 | A * | 3/1981 | Bergman | 222/333 |
| 2007/0269251 | A1 * | 11/2007 | Skalitzky et al. | 401/2 |

* cited by examiner

*Primary Examiner* — David Walczak
*Assistant Examiner* — Joshua Wiljanen
(74) *Attorney, Agent, or Firm* — David K. Benson

(57) ABSTRACT

Personal care product dispenser systems include a dispenser and a base station. The dispenser comprises a casing including a personal care product and a shaft. The personal care product is disposed within the casing and comprises an anti-perspirant or deodorant. The shaft extends through a portion of the casing and including a first end and a second end and is configured to advance the personal care product through the casing when rotated in a first direction. The second end has a chuck contact surface defining a first shape. The base station includes a motor and a chuck. The motor is operatively coupled to the chuck and is configured to rotate the chuck, and the chuck has a wheel contact surface to correspond to the first shape of the chuck contact surface. The base station is configured to rotate the chuck when the dispenser is mounted to the base station.

14 Claims, 3 Drawing Sheets

PERSONAL CARE PRODUCT DISPENSER SYSTEMS

TECHNICAL FIELD

The inventive subject matter generally relates to personal care products, such as antiperspirant and/or deodorants, and more particularly relates to personal care product dispenser systems.

BACKGROUND

Antiperspirants and deodorants are popular personal care products used to prevent or eliminate sweat and body odor caused by sweat. Antiperspirants typically prevent the secretion of sweat by blocking or plugging sweat secreting glands, such as those located at the underarms. Deodorants counteract or mask the unwanted odors caused by bacterial flora in secreted sweat.

Antiperspirant and/or deodorant products may be dispensed in various manners. In some cases, the product may be supplied as a solid product material housed in a container having an open end through which access to the product material may be provided. The product material may be disposed on a screw-type elevating mechanism which extends through a portion of the container and can be driven by a rotatable handwheel. In order to advance the product toward an opening in the container, the handwheel may be rotated in a first (e.g., clockwise) direction to a particular position to thereby extend a portion of the product material beyond the container opening. If desired, the handwheel alternatively may be rotated in an opposite (e.g., counter-clockwise) direction to retract the product material into the container. However, for some users, the rotatable handwheel may be relatively difficult to rotate.

Accordingly, it is desirable to have improved mechanisms for dispensing antiperspirant and/or deodorants that are easier to use than conventional rotatable handwheel configurations. In addition, it is desirable for the improved mechanisms to be relatively simple to manufacture. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Personal care product dispenser systems are provided.

In an embodiment, by way of example only, a system includes a dispenser and a base station. The dispenser comprises a casing including a personal care product and a shaft. The personal care product is disposed within the casing and comprises an antiperspirant or deodorant. The shaft extends through a portion of the casing and including a first end and a second end and is configured to advance the personal care product through the casing when rotated in a first direction. The second end has a chuck contact surface defining a first shape. The base station includes a motor and a chuck. The motor is operatively coupled to the chuck and is configured to rotate the chuck, and the chuck has a wheel contact surface to correspond to the first shape of the chuck contact surface. The base station is configured to rotate the chuck when the dispenser is mounted to the base station.

In another embodiment, by way of example only, a system includes a base station comprising a motor and a chuck, the motor operatively coupled to the chuck and configured to rotate the chuck, the chuck having a wheel contact surface to correspond to the first shape of the chuck contact surface, wherein the base station is configured to rotate the chuck when the dispenser is mounted to the base station.

In still another embodiment, by way of example only, a system includes a dispenser and a dispenser adaptor. The dispenser comprises a casing including a personal care product and a shaft, the personal care product disposed within the casing and comprising an antiperspirant or deodorant, the shaft extending through a portion of the casing and including a first end and a second end, the shalt configured to advance the personal care product through the casing when rotated in a first direction, and the second end having a chuck contact surface defining a first shape. The dispenser adaptor has an outer surface and an inner surface, the outer surface of the dispenser adaptor shaped to correspond with the first shape of the chuck contact surface, and the inner surface of the dispenser adaptor defining a cavity having a second shape.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
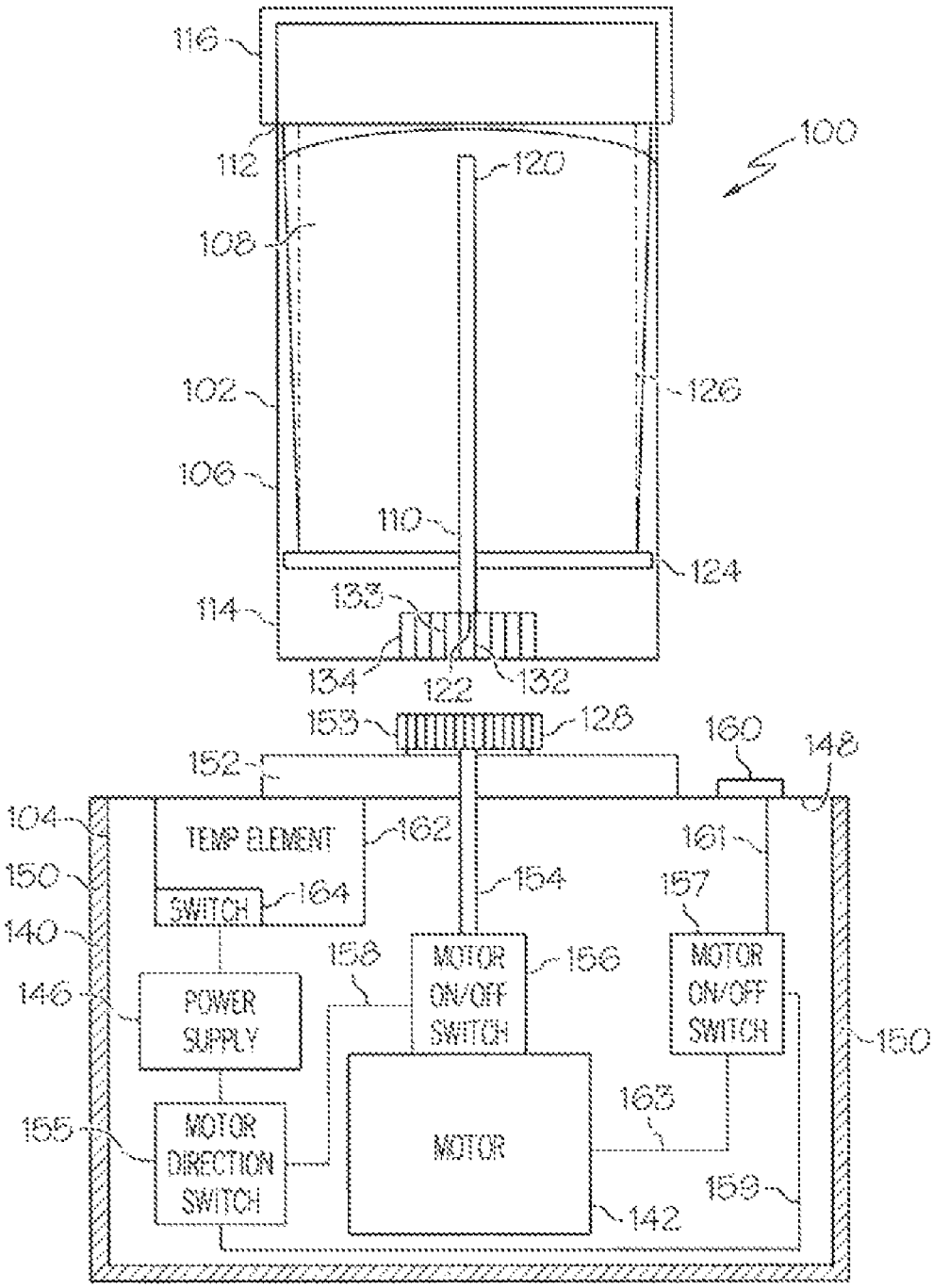
FIG. 1 is a simplified, schematic view of a personal care product dispenser system, according to an embodiment.

FIG. 1 is a simplified, schematic view of a personal care product dispenser system 100, according to an embodiment. The system 100 includes a dispenser 102 and a base station 104, in an embodiment. The dispenser 102 may be employed for dispensing a spreadable cosmetic and/or health and beauty product material, such as an antiperspirant and/or deodorant. In this regard, the dispenser 102 comprises a casing 106, a product material 108, and a shaft 110, in an embodiment. The casing 106 is generally tubular and may have an interior compartment, a main opening 112 and an enclosed end 114. The casing 106 is configured to house at least the product material 108 and the shaft 110. Accordingly, the casing 106 may have a circular, ovular, rectangular or other radial cross-sectional shape. In an embodiment, the casing 106 may have a length in a range of about 2 cm to about 8 cm, a width in a range of about 2 cm and about 2 cm, and a height in a range of about 8 cm to about 15 cm. In other embodiments, the casing 106 may have larger or smaller dimensions than the aforementioned ranges. According to an embodiment, the casing 106 may comprise a relatively lightweight, durable material such as plastic, metal, ceramic, glass, or any combination of the aforementioned materials.

According to an embodiment, a portion of the casing 106 may have an inner surface defining sidewalls of the interior compartment, and the interior compartment may be shaped to correspond to a desired shape of an outer diameter of the product material 108. The main opening 112 defined by ends of the sidewalls provides entry into the compartment. In an embodiment, the product material 108 may comprise a solid formulation of the antiperspirant or deodorant. In other embodiments, the product material 108 may comprise a gel formulation or another suitable formulation for delivering a spreadable cosmetic product, such as the antiperspirant or the deodorant, over a user's skin. According to an embodiment, a cap 116 may be disposed over the main opening 112 to prevent contamination when the product is not in use. Although the main opening 112 is shown as being located at an end of the casing 106, it may be located at a different portion of the casing 106 in other embodiments.

In an embodiment, the shaft 110 extends through the casing 106 and the product material 108. In an embodiment, the shaft 110 includes a first end 120 and a second end 122 and may extend through an entirety of the casing 106. For example, the shaft 110 may have a length in a range of about 5 cm to about 12 cm and an average diameter in a range of about 0.3 cm to about 1 cm. In other embodiments, the shaft 110 may be longer or shorter than the aforementioned ranges. In any case, the first end 120 of the shaft 110 is disposed in the product material 108. The shaft 110 may be configured to cooperate with another component in the advancement of the product material 108 through the casing 106. In an example, the shaft 110 may have threading, and the product material 108 may be disposed on a platform 124. In such case, the platform 124 may define a bottom wall of the compartment within which the product material 108 is disposed, and the shaft 110 may extend through an opening in the platform 124. As the shaft 110 is rotated, the threading provides torque to the platform 124 to advance the platform 124 and the product material 108 through the casing 106.

In another embodiment, the casing 106 may include a container 126 (shown in phantom) having an inner surface defining sidewalls of the compartment for the product material 108. According to an embodiment, the container 126 may have an outer surface that corresponds to that of the inner surface of the casing 106 or that has dimensions that are smaller than those defined by the inner surface of the casing 106. In an embodiment, the container 126 may have a bottom wall, which may be located substantially opposite the main opening 112. In another embodiment, the container 126 may have another open end that is substantially opposite the main opening 112, and the platform 124 may be disposed over the open end to form a bottom wall. According to an embodiment, the platform 124 may comprise a relatively flat plate, grid, mesh or combination thereof.

Figure 2:
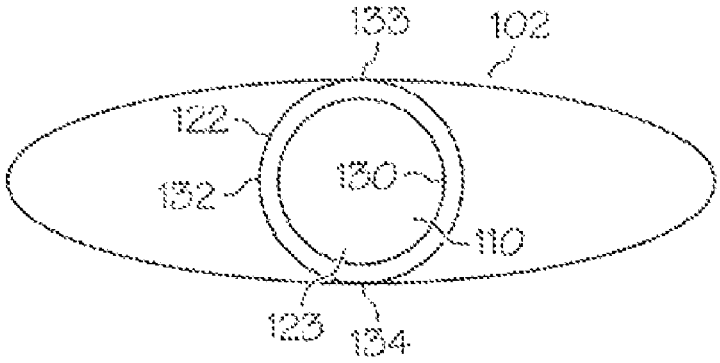
FIG. 2 is an end view of a personal care product dispenser of the system of FIG. 1, according to an embodiment.

FIG. 2 is an end view of the personal care product dispenser 102 of the system 100 of FIG. 1, according to an embodiment. In particular, FIG. 2 depicts an embodiment of a wheel 133 attached to the second end 122 of the shaft 110. The wheel 133 is configured to be manipulated to thereby rotate the shaft 110. In an embodiment, wheel 133 may have a chuck contact surface defining a first shape that is configured to correspond to a wheel contact surface of a chuck 128 (FIG. 1) of the base station 104. The first shape may be a polygon, a non-circular or an asymmetrical shape. In an example, wheel 133 may include a hollow or depressed area 123 and the sidewalls 130 of the depressed area 123 may define the chuck contact surface. In another embodiment, outer sidewalls 132 of the wheel 133 may define the chuck contact surface.

With reference to FIGS. 1 and 2, in accordance with an embodiment, the casing 106 may include a slot 134 that is configured to provide access to the wheel 133 and thus the shaft 110 so that the user may control the advancement of the product material 108 through the casing 106. For example, a portion of the sidewalls 132 of the wheel 133 may protrude through the slot 134 to act as a grip surface that may be manipulated by the user. The grip surface may be a relatively smooth surface, in an embodiment. In another embodiment, the grip surface may be ridged, roughened or may have other features to provide improved traction for the user. Although the slot 134 is depicted in FIG. 1 as being located adjacent to the enclosed end 114 of the casing 106, the slot 134 may be located in other positions in other embodiments.

The base station 104 is configured to provide a mounting stand for the dispenser 102 and to assist the user in advancing the product material 108 through the dispenser 102. In this regard, the base station 104 may include a housing 140, a motor 142, and the chuck 128, in an embodiment. The housing 140 is configured to contain the motor 142, in an embodiment. In another embodiment, the housing 140 may further include a power supply 146, although power may be supplied to the base station 104 from an external source, as well. In still another embodiment, the housing 140 may further include a motor direction switch 156, a motor on/off switch 158, 160, and/or a temperature control element 162.

To suitably house components of the base station 104, the housing 140 may have a length in a range of about 10 cm to about 15 cm, a width in a range of about 10 cm to about 15 cm, and height in a range of about 5 cm to about 10 cm, in an embodiment. However, particular dimensions of the housing 140 may depend on the configurations of the dispenser 102 and/or the motor 142. Although the housing 140 is depicted as being a box with a rectangular cross section, the housing 140 may have a different shape. In some embodiments, the housing 140 may have an ornamental shape and may serve as a fashionable storage location for the dispenser 102. In another embodiment, the housing 140 may be embellished with colors, patterns or other desirable motifs that may appeal to a user or promote a product or organization. In any case, the housing 140 may include at least a mount wall 148 and sidewalls 150. The mount wall 148 is configured to provide a surface to which the dispenser 102 may be supported during storage and/or base station operation.

Figure 3:
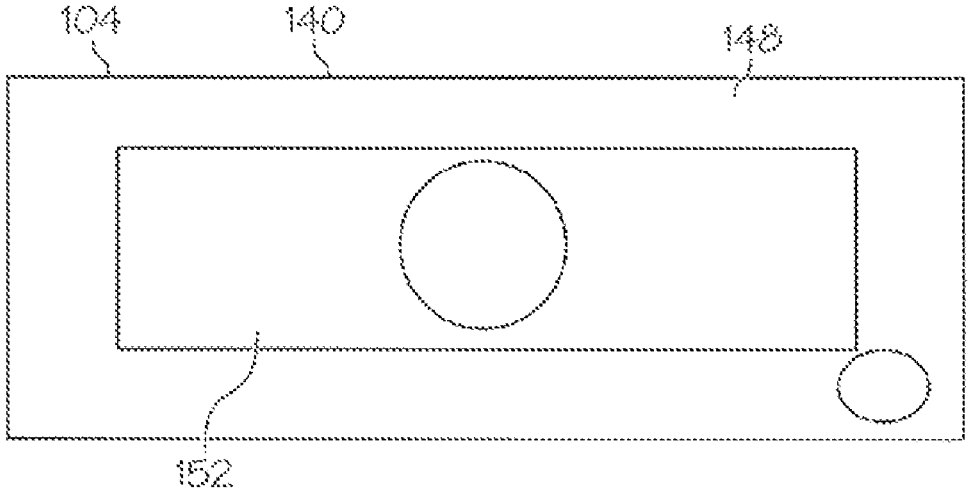
FIG. 3 is an end view of a base station of the system of FIG. 1, according to an embodiment.

FIG. 3 is an external, end view of the base station 104 of the system 100 of FIG. 1, according to an embodiment. With reference to FIGS. 1 and 3, for example, the mount wall 148 may define a top surface of the base station 104. In other embodiments, the mount wall 148 may define a side surface of the base station 104. In an embodiment, the mount wall 148 may include an elevated stage 152 to provide additional visibility to the location on which the dispenser 102 is to be placed. In an example, the stage 152 may be raised relative to the surface of the mount wall 148. According to an embodiment, the stage 152 may be formed in the mount wall 148. In another embodiment, the mount wall 148 may include an opening and the stage 152 may be attached over the opening. In an embodiment, the stage 152 is snap-fit into the opening. In another embodiment, the stage 152 is adhered or otherwise coupled to the mount wall 148. The stage 152 may comprise a structurally robust material suitable for mounting the dispenser 102, such plastic, metal or other material. In some embodiments, the stage 152 may be configured to be capable of conducting heat and may comprise metal, ceramic or another conductive material.

Figure 4:
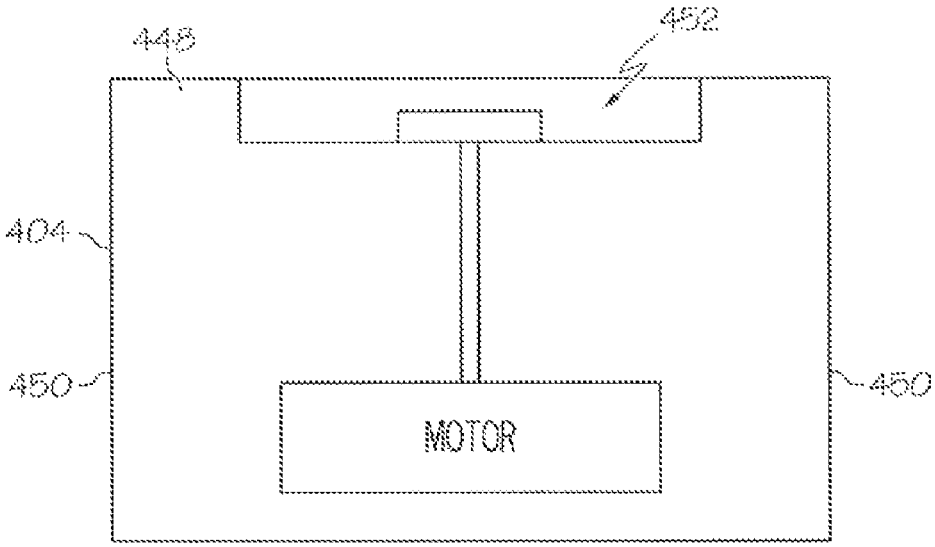
FIG. 4 is simplified, schematic view of a personal care product dispenser, according to another embodiment.

FIG. 4 is a simplified schematic of a base station 404, according to another embodiment. In an embodiment, the base station 404 includes a mount wall 448 and sidewalls 450 containing various components of the base station 404 (e.g., a motor, chuck, power supply, and the like). In accordance with an embodiment, the mount wall 448 of the base station 404 may include a depression 452 defining a space corresponding to a shape of the enclosed end 114 (FIG. 1) of the dispenser 102. According to an embodiment, the depression 452 is formed into the mount wall 448. In another embodiment, the depression 452 is included in an open-ended box or cup, and the box or cup is disposed over an opening formed in the mount wall 448. In an embodiment, the depression 452 is snap-fit into the opening. In another embodiment, the depression 452 is adhered or otherwise coupled to the mount wall 448. The depression 452 may comprise a structurally robust material suitable for mounting the dispenser 102, such plastic, metal or other material. In some embodiments, the depression 452 may be configured to be capable of conducting heat and may comprise metal, ceramic or another conductive material.

Returning to FIGS. 1 and 3, according to an embodiment, the chuck 128 is disposed over the mount wall 148 and is operatively coupled to the motor 142, which is configured to rotate the chuck 128 in response to a user command. The chuck 128 has an exposed outer surface 153 having a shape corresponding to the first shape of the second end 122 of the shaft 110. To rotate the chuck 128, a spindle 154 may extend from the chuck 128 and through the mount wall 148. The spindle 154 may be coupled to the motor 142. In an embodiment, the motor 142 may comprise an electric motor that is capable of being electrically coupled to the power supply 146. In accordance with an embodiment, power may be supplied to the base station 104 from another source (e.g., alternating current (AC) line power). In such an embodiment, the motor 142 may be coupled to a cable, wire or another conductive conduit capable of serving as an electrical connection to the AC line power source (e.g., via an electrical outlet). In another embodiment, the power supply 146 may be a battery or another self-contained source of DC power.

To control motor operation, various motor switches may be electrically connected to the motor 142. In an embodiment, a motor direction switch 155 may be adapted to move between a first current direction and a second current direction between the power supply 146 and the motor 142. In an embodiment, the first current direction may be a first rotational direction of the motor 142, and the second current direction may reverse direction of the motor 142. For example, the first rotational direction may allow the chuck 128 to rotate in a clockwise direction, while the second rotational direction may allow the chuck 128 to rotate in a counter-clockwise direction. In other embodiments, to operate the motor 142 itself, one or more motor on/off switches 156, 157 may be included. One or more lines 158, 163 couple the motor direction switch 155 to the motor on/off switch 156. The lines 158, 163 may comprise a wire, cable or another conduit by which the switches 155, 156 may communicate.

In an embodiment, the motor on/off switch 156, 157 is adapted to move between a conductive or closed position and a non-conductive or open position, in response to a user command. The motor on/off switch 156 may be activated by and, thus, operatively coupled to, the motor 142, which in turn is coupled to the chuck 128. For example, when the dispenser 102 is mounted to the chuck 128, the user may move the dispenser 102, and hence, the chuck 128, between a neutral position and a depressed position. In such an embodiment, a spring may be included as part of the motor on/off switch 156, so that when the chuck 128 is depressed, the spring of the motor on/off switch 156 contracts and maintains the spindle 154 in a position causing the motor on/off switch 156 to move to the conductive position. When the chuck 128 is pressed again, the spring may be configured to expand to thereby release the spindle 154 from the depressed position and cause the chuck 128 to move to a neutral position. If the depressed position is an unlatched position, the user may simply lift the personal care product from the dispenser to release spindle 154 from the depressed position and cause the chuck 128 to move to a neutral position. When in the chuck 128 is in the neutral position, the motor on/off switch 156 is in a non-conductive position thereby preventing operation of the motor 142.

In another embodiment, the chuck 128 may be configured to be rotated by the user (via the dispenser 102 when the dispenser 102 is positioned over the chuck 128) between a first radial position and a second radial position. In such an embodiment, the spindle 154 operatively communicates with the spring of the motor on/off switch 156. When the spindle 154 in communication with the chuck 128 rotates with the chuck 128 to the first radial position, the motor on/off switch 156 moves to the non-conductive position. In another embodiment, when the chuck 128 is moved to the second radial position, the spindle 154 also moves to thereby move the motor on/off switch 156 to the conductive position. When the motor on/off switch 156 is in the conductive position, the motor 142 rotates the chuck 128, which in turn rotates the wheel 133 and shaft 110 of the dispenser 102.

In still another embodiment, a button 160 may be employed to move a motor on/off switch 157 between conductive and non-conductive positions. In this regard, a line 161 may operatively couple the motor on/off switch 157 to the button 160. In an example, the button 160 may be disposed over the mount wall 148 or another sidewall 150 of the housing 140. The button 160 may be configured to be depressed, rotated or otherwise manipulated by the user to thereby move the switch between an open and conductive position. In an embodiment, the button 160 may be manipulated to move between a neutral position and a depressed position such that when the button 160 is in the neutral position, the motor on/off switch 157 is in the non-conductive position, and when the button 160 is in the depressed position, the motor on/off switch 157 is in the conductive position.

In some embodiments, the base station 104 may be configured to perform additional operations. In an example, the base station 104 may include a temperature control element 162 configured to heat or cool a surface of the base station 104 to thereby heat or cool the dispenser 102 and/or the product material 108 in the dispenser 102. In accordance with an embodiment, the surface of the base station 104 may comprise the mount wall 148, the chuck 128 or another surface configured to contact the dispenser 102, wheel 133, and/or shaft 110. The temperature control element 162 may be in contact with or thermally coupled to the surface to be heated or cooled. In another embodiment, the temperature control element 162 is electrically coupled to the power supply 146 by a line 163, and a second switch 164 associated with the temperature control element 162 may be included to turn the element 162 on or off.

Figure 5:
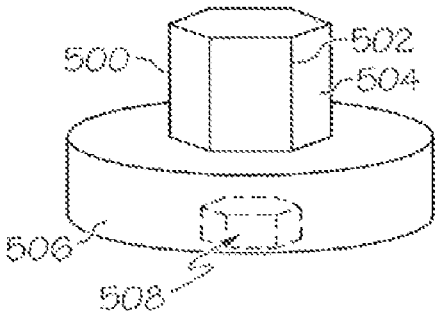
FIG. 5 is a side exterior view of a dispenser adaptor, according to an embodiment.

To provide the ability to substitute the first shape of the chuck contact surface defined by the wheel 133 for a different shape, one or more adaptors may be included as part of the system 100. FIG. 5 is a dispenser adaptor 500, according to an embodiment. In an embodiment, the dispenser adaptor 500 may be configured to be coupled to (e.g., either temporarily or permanently) the chuck contact surface defined by the wheel 133. In such case, the dispenser adaptor 500 may have a dispenser attachment portion 502 having an outer surface 504 that corresponds with the first shape of the chuck contact surface of the wheel 133, enabling the attachment portion 502 to mate with the chuck contact surface. The dispenser adaptor 500 may comprise a material, such as plastic, metal or another material. The dispenser adaptor 500 may further include a base station attachment portion 506 configured to include a cavity 508 (shown in phantom) shaped to correspond to a shape of a wheel contact surface of a chuck. For example, in an embodiment in which a second, different base station (other than base station 104) is to be employed, the cavity 508 may have a second shape that corresponds to the shape of a wheel contact surface of chuck of the second base station. Although the dispenser adaptor 500 is shown as being generally cylindrical and having smooth surfaces, in other embodiments, the dispenser adaptor 500 may have another shape and may not have smooth surfaces. Moreover, when provided as a system, two or more dispenser adaptors each having cavities (e.g., cavity 508) that are differently shaped may be included.

Figure 6:
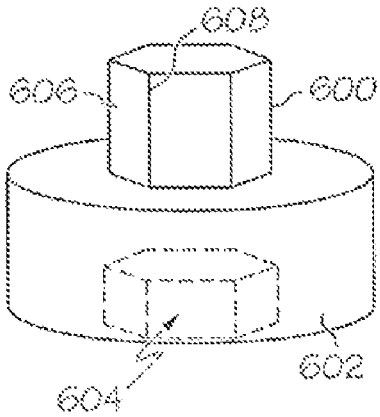
FIG. 6 is a side exterior view of a base station adaptor, according to an embodiment.

According to another embodiment, adaptors may be included in the system 100 to allow the base station 104 to operate with various personal care product dispensers, where two or more of the dispensers include differently shaped chuck contact surfaces. FIG. 6 is a base station adaptor 600, according to an embodiment. In an embodiment, the base station adaptor 600 may be configured to be coupled to (e.g., either temporarily or permanently) the chuck 128 (FIGS. 1 and 3) of the base station 104. In such case, the base station adaptor 600 may have a base station attachment portion 602 having an inner surface defining a cavity 604 (shown in phantom) corresponding with the wheel contact surface of the chuck 128, enabling the attachment portion 602 to mate with the chuck 128. The base station adaptor 600 may comprise a material, such as plastic, metal or another material. The base station adaptor 600 may further include a dispenser attachment portion 606 configured to include an outer surface 608 shaped to correspond to a chuck contact surface of a wheel. For example, the outer surface 608 of the dispenser attachment portion 606 may have a second shape that is different from the first shape described above. Although the base station adaptor 600 is shown as being generally cylindrical and having smooth surfaces, in other embodiments, the base station adaptor 600 may have another shape and may not have smooth surfaces. Moreover, when provided as a system, two or more base station adaptors each having outer surfaces (e.g., outer surface 608) that are differently shaped may be included.

A personal care product dispenser system has now been provided that may be more user-friendly than conventional rotatable handwheel configurations. Specifically, by placing the personal care product dispenser on a designated location on a base station and pushing the personal care product dispenser against the base station or pressing a button on the base station to cause the personal care product in the dispenser to advance, the user may exert less effort in advancing personal care product than when using a dispenser including the conventional rotatable handwheel configuration. Additionally, by providing the system with various separate components and adaptors, one or more of the components may be fitted with an appropriately shaped adaptor to thereby allow the base station to operate with two or more dispensers having variously shaped ends.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and an arrangement of elements described in an exemplary embodiment without departing from the scope of the inventive subject matter as set forth in the appended claims.

What is claimed is:

1. A personal care product dispenser system comprising:

a dispenser comprising a casing including a personal care product and a shaft, the personal care product disposed within the casing and comprising an antiperspirant or deodorant, the shaft extending through a portion of the casing and including a first end and a second end, the shaft configured to advance the personal care product through the casing when rotated in a first direction, and the second end having a chuck contact surface defining a first shape; and a base station comprising a motor and a chuck, the motor operatively coupled to the chuck and configured to rotate the chuck, the chuck having a wheel contact surface to correspond to the first shape of the chuck contact surface, wherein the base station is configured to rotate the chuck when the dispenser is mounted to the base station, wherein the chuck is operatively coupled to the motor switch and configured to be rotated between a first radial position and a second radial position, when the chuck is in the first radial position, the motor switch is in the non-conductive position, and when the chuck is in the second radial position, the switch is in the conductive position to thereby cause the motor to rotate the chuck.

2. The dispenser system of claim 1, further comprising:

a base station adaptor having an inner surface and an outer surface, the inner surface of the base station adaptor defining a cavity corresponding with the wheel contact surface of the chuck and the outer surface of the base station adaptor defining a second shape that is different from the first shape of the chuck contact surface.

3. The dispenser system of claim 1, further comprising:

a dispenser adaptor having an outer surface and an inner surface, the outer surface or the dispenser adaptor shaped to correspond with the first shape or the chuck contact surface, and the inner surface of the dispenser adaptor defining a cavity having a second shape that is different from the wheel contact surface of the chuck.

4. The dispenser system of claim 1, further comprising a motor switch adapted to move between a conductive position and non-conductive position in response to a user command.

5. The dispenser system of claim 4, wherein the chuck is operatively coupled to the motor switch and configured to move between a neutral position and a depressed position, when the chuck is in the neutral position, the motor switch is in the non-conductive position, and when the chuck is in the depressed position, the motor switch is in the conductive position to thereby cause the motor to rotate the chuck.

6. The dispenser system of claim 4, further comprising a button disposed on the base station, the button operatively coupled to the motor switch and configured to move between a neutral position and a depressed position, wherein when the chuck is in the neutral position, the motor switch is in the non-conductive position, and when the chuck is in the depressed position, the motor switch is in the conductive position to thereby cause the motor to rotate the chuck.

7. The dispenser system of claim 1, further comprising a temperature control element disposed in the base station and electrically coupled to a power supply, the temperature control element configured to provide heat to a surface of the base station.

8. A personal care product dispenser system for use with a dispenser that has a chuck contact surface with a first shape, the system comprising:

a base station comprising a motor and a chuck, the motor operatively coupled to the chuck and configured to rotate the chuck, the chuck having a wheel contact surface to correspond to the first shape of the chuck contact surface, wherein the base station is configured to rotate the chuck when the dispenser is mounted to the base station, wherein the chuck is operatively counted to the switch and configured to be rotated between a first radial position and a second radial position, when the chuck is in the first radial position, the switch is in the non-conductive position, and when the chuck is in the second radial position, the switch is in the conductive position to thereby cause the motor to rotate the chuck.

9. The dispenser system of claim 8, further comprising a motor switch adapted to move between a conductive position and a non-conductive position in response to a user command.

10. The dispenser system of claim 9, wherein the chuck is operatively coupled to the motor switch and configured to move between a neutral position and a depressed position, when the chuck is in the neutral position, the motor switch is in the non-conductive position, and when the chuck is in the depressed position, the motor switch is in the conductive position to thereby cause the motor to rotate the chuck.

11. The dispenser system of claim 9, further comprising a button disposed on the base station, the button operatively coupled to the motor switch and configured to move between a neutral position and a depressed position, wherein when the chuck is in the neutral position, the switch is in the non-conductive position, and when the chuck is in the depressed position, the switch is in the conductive position to thereby cause the motor to rotate the chuck.

12. The dispenser system of claim 8, further comprising a temperature control element disposed in the base station and electrically coupled to a power supply, the temperature control element configured to provide heat to a surface of the base station.

13. The dispenser system of claim 8, further comprising a first base station adaptor having an inner surface and an outer surface, the inner surface of the base station adaptor defining a cavity corresponding with the first shape of the chuck contact surface and the outer surface of the base station adaptor defining a second shape.

14. The dispenser system of claim 13, further comprising a second base station adaptor having an inner surface and an outer surface, the inner surface of the second base station adaptor defining a cavity corresponding with the first shape of the chuck contact surface and the outer surface of the second base station adaptor defining a third shape that is different from the second shape.

* * * * *